US009554685B2

(12) United States Patent
Gadsden

(10) Patent No.: US 9,554,685 B2
(45) Date of Patent: Jan. 31, 2017

(54) MOP/BROOM WITH AN AIR DRYER

(71) Applicant: Gwendolyn Gadsden, Ocala, FL (US)

(72) Inventor: Gwendolyn Gadsden, Ocala, FL (US)

( * ) Notice: Subject to any disclaimer, the term of this patent is extended or adjusted under 35 U.S.C. 154(b) by 0 days.

(21) Appl. No.: 14/943,674

(22) Filed: Nov. 17, 2015

(65) Prior Publication Data

US 2016/0353961 A1 Dec. 8, 2016

Related U.S. Application Data

(63) Continuation-in-part of application No. 14/733,677, filed on Jun. 8, 2015, now abandoned.

(51) Int. Cl.

| | |
|---|---|
| ***A47L 13/12*** | (2006.01) |
| ***A47L 13/20*** | (2006.01) |
| ***A46B 15/00*** | (2006.01) |
| ***B08B 5/02*** | (2006.01) |

(52) U.S. Cl.

CPC ..... *A47L 13/12* (2013.01); *A46B 15/0002* (2013.01); *A47L 13/20* (2013.01); *B08B 5/02* (2013.01)

(58) Field of Classification Search

CPC ..... A47L 13/12; A47L 13/20; A46B 15/0002; B08B 5/02

See application file for complete search history.

(56) References Cited

U.S. PATENT DOCUMENTS

| | | | | |
|---|---|---|---|---|
| 4,972,541 | A * | 11/1990 | Smith, Jr. | A47L 13/38 15/105 |
| 5,722,112 | A * | 3/1998 | Scanni | A47L 5/24 15/344 |
| 5,839,158 | A * | 11/1998 | Schupp | A47L 5/24 15/144.4 |
| 6,799,350 | B1 * | 10/2004 | Gordon | A47L 5/24 15/1.51 |
| 7,571,514 | B2 * | 8/2009 | Shih | A47L 9/0472 15/363 |
| 8,769,766 | B2 * | 7/2014 | Hilton | A46B 9/02 15/344 |

* cited by examiner

*Primary Examiner* — Dung Van Nguyen
(74) *Attorney, Agent, or Firm* — The Law Office of Jerry D. Haynes

(57) ABSTRACT

A mop air dryer combination comprising: a mop head; an air dryer, wherein the air dryer is positioned above the mop head; an adjustable clip extending from the air dryer; and a handle inserted into the adjustable clip extending from the air dryer. In one particular embodiment, the handle further includes an audio player or a radio integrated into the handle. Alternatively in another exemplary embodiment, the air dryer may be used in conjunction with a broom.

10 Claims, 3 Drawing Sheets

MOP/BROOM WITH AN AIR DRYER

CROSS REFERENCE TO OTHER APPLICATIONS

This application is a continuation in part to U.S. patent application Ser. No. 14/733,677 filed on Jun. 8, 2015.

BACKGROUND OF THE INVENTION

Field of Invention

The present invention relates to a mop/broom that includes an air dryer to assist in drying the floor surface after mopping.

Description of Related Art

Many individuals utilize mops to clean the floor surface of a building or residence. Further mops may also be used exterior areas but principally on the interior of buildings and homes. The conventional mop includes a handle and a grouping of strands of cloth attached at one end of the handle. The strands of cloth comprise the essential functioning portion of the mop. During use an individual dampens the strands of cloth and then applies the strands of cloth onto the floor for cleaning. The strands of cloth must normally be squeezed to release any excess moisture. Also mopping involves a bucket or container that is available to the user to insert the strands of cloth and dampen the cloth then apply the mop head over the surface of a floor. The mop provides a means to clean a floor surface, however once the floor is wet then a period of time needs to elapse before the floor's surface is completely dry. Normally the mopping leaves a wet film over the floor and therefore creates a slip and fall hazard for anyone that may transverse the floor after mopping. Many times individuals that clean buildings place warnings signs of a wet floor after mopping the floor to ensure individuals have an opportunity to avoid the wet floor or to proceed with caution over the wet floor. In certain instances individuals will employ the use of fans in order to assist in drying the floor after the mopping of the floor surface. Consequently, it would be advantageous to have a fan handy for the user of a mop in order to speed the drying time of the floor after the mopping thereof.

SUMMARY OF THE INVENTION

The present invention relates to a mop air dryer combination comprising: a mop head; an air dryer, wherein the air dryer is positioned above the mop head; an adjustable clip extending from the air dryer; and a handle inserted into the adjustable clip extending from the air dryer. In one particular embodiment, the handle further includes an audio player or a radio integrated into the handle. Alternatively in another exemplary embodiment, the air dryer may be used in conjunction with a broom.

DETAILED DESCRIPTION

The present invention relates to a mop that includes an air dryer attached or integrated into the handle of the mop. The integration of the air dryer provides a handy fan air dryer to speed the drying process of a floor after it has been mopped with the mop in accordance with the present invention. In an alternative embodiment, the dryer may be integrated into a broom handle.

Figure 1:
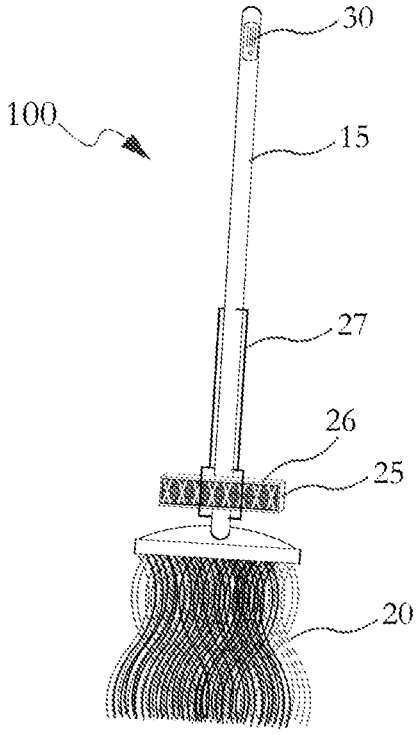
FIG. 1 depicts a view of a mop and air dryer device in accordance with the present invention.
Figure 2:
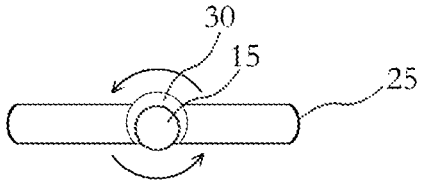
FIG. 2 depicts a top view of the mop and air dryer device in accordance with the present invention.

In reference to FIG. 1, a mop air dryer combination 100 is depicted. The mop air dryer 100 includes a handle 15 and a mop head 20. Between the mop head 20 and the handle 15 lies an air dryer 25. The air dryer 25 is integrated into the handle through the use of an adjustable and flexible clip arrangement 27. The air dryer 25 includes a series of fans within a fan housing. The fan housing pivots to assist in directing air flow to the floor surface during mopping. The fan housing rotates radially around the circumference of the handle 15 as shown in FIG. 2. The clip arrangement 27 allows the release of the handle 15 from the air dryer 25 and then enables the individual to place the air dryer 25 in a position to effectively dry the floor surface that may have been mopped using the mop head 20. The mop air dryer 100 in accordance with the present invention consequently provides an air drying function integrated with the mop handle 15.

In one exemplary embodiment, an activation sensor is provided within the mop head 20, which detects surface movement. Upon active detection, the dryer 25 is turn on and an air flow is directed from the fan housing to the floor surface below the mop handle.

The clip arrangement 27 as depicted in FIG. 1 provides a means to remove the handle 15 and therefore place the air dryer 25 in a position to effectively dry a surface area of a floor. Further as the air dryer 25 dries the surface of the floor the flow of the air may also assist in the drying of the mop head 20. As an additional feature of the mop air dryer device 100, an audio player 30 is integrated in the handle 15. The audio player 30 provides a means for the user to enjoy music or other broadcasts while using the mop air dryer assembly 100. The incorpation of the audio player 30 helps to add some audio stimulation of the user of the air dryer assembly 100.

Figure 3A:
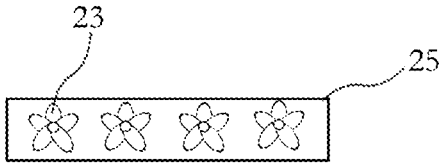
FIG. 3A depicts a front view of fans used in an air dryer device in accordance with the present invention.

FIG. 2 shows a top view of the air dryer 25 and shows the radial movement of the air dryer 25. The air dryer 25 includes individual fans 23 shown in FIG. 3A, which depicts a front view of the dryer 25 without a grill. FIG. 1 shows the dryer 25 with a grill 26. The grill 26 is removable and is shown as such in FIG. 3A. In this particular embodiment, four fans 23 are shown, however the number of fans may vary in both size and number.

Figure 3B:
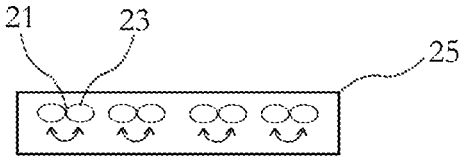
FIG. 3B depicts a top view of fans used in an air dryer device in accordance with the present invention.

A top sectional view is shown in FIG. 3B. This top view shows the fans 23 with a pivot point 21. As shown, the fans within the housing 25 may pivot and provide additional rotation therefore in addition to the dryer 25 rotating about the broom handle 15 the fans 23 within the housing 25 also rotate in a radial motion. This movement of both the dryer 25 and the fans 23 within the housing 25 therefore provide a significant breadth of air flow from the fan housing 25.

Figure 4:
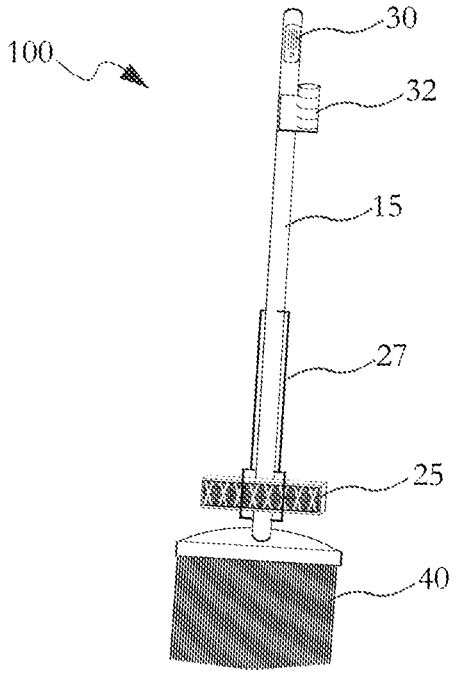
FIG. 4 depicts a view of a broom and air dryer device in accordance with the present invention.

FIG. 4 depicts alternative embodiment of the present invention. The handle 25 is now attached to a broom 40 as shown in FIG. 4. This broom 40 includes the attachment of the air dryer 25 and also shows additional attachment of a cup holder 32 at the top portion of the handle 15. This particular embodiment is used for sweeping purposes and includes the fan to be used in conjunction with the broom 40. The cup holder 32 enables the user to place a bottled beverage in the cup holder 32, such as a bottle of water, soda or other beverage, so that the user may quench their thirst during use of the broom 40. The instant invention has been shown and described in what it considers to be the most practical and preferred embodiments. It is recognized, however, that departures may be made there from within the scope of the invention and that obvious modifications will occur to a person skilled in the art.

What is claimed is:

1. A mop air dryer combination comprising:

a mop head;

an air dryer, where the air dryer is positioned above the mop head;

a clip arrangement that secures the air dryer to a handle extending from the mop head; and a plurality of fans within the air dryer, wherein said fans are capable of radial rotation and further where the housing laterally rotates about a mop handle.

2. The mop air dryer combination according to claim 1, wherein the mop handle further includes an audio player.

3. The mop air dryer combination according to claim 1, wherein the mop handle includes a radio integrated into the handle.

4. The mop air dryer combination according to claim 1, where the mop handle is removable from the clip arrangement.

5. The mop air dryer combination according to claim 1, where the mop handle includes a cup holder.

6. A broom dryer combination comprising:

a broom head;

an air dryer, where the air dryer is positioned above the broom head;

a clip arrangement that secures the air dryer to a handle extending from the broom head; and a plurality of fans within the air dryer, wherein said fans are capable of radial rotation and further where the housing laterally rotates about the broom handle.

7. The broom air dryer combination according to claim 1, wherein the broom handle further includes an audio player.

8. The broom air dryer combination according to claim 1, wherein the broom handle includes a radio integrated into the handle.

9. The broom air dryer combination according to claim 1, where the broom handle is removable from the clip arrangement.

10. The broom air dryer combination according to claim 1, where the broom handle includes a cup holder.

* * * * *